US011608621B1

(12) United States Patent
Pilarczyk et al.

(10) Patent No.: US 11,608,621 B1
(45) Date of Patent: Mar. 21, 2023

(54) SHOWER DRAIN AND PROTECTIVE COVER

(71) Applicant: WCM Industries, Inc., Colorado Springs, CO (US)

(72) Inventors: Eric Pilarczyk, Colorado Springs, CO (US); William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 17/506,211

(22) Filed: Oct. 20, 2021

(51) Int. Cl.
*E03C 1/264* (2006.01)

(52) U.S. Cl.
CPC ..... *E03C 1/264* (2013.01)

(58) Field of Classification Search
CPC . E03C 1/232; E03C 1/22; E03C 1/262; E03C 1/26; E03C 1/264
USPC ..... 4/292
See application file for complete search history.

(56) References Cited

U.S. PATENT DOCUMENTS 1,236,450 A * 8/1917 Kohler ..... E03C 1/22 4/288
1,342,046 A * 6/1920 Heino ..... E03C 1/264 285/192
3,896,511 A * 7/1975 Cuschera ..... E03C 1/22 4/288
4,092,745 A * 6/1978 Oropallo ..... E03F 5/0408 4/292
4,146,939 A * 4/1979 Izzi ..... E03C 1/26 4/286
4,562,602 A * 1/1986 Cuschera ..... E03C 1/22 4/286
5,890,241 A 4/1999 Ball
6,637,050 B1 10/2003 Ball
6,675,406 B2 1/2004 Ball
6,691,411 B2 2/2004 Ball
7,127,752 B2 10/2006 Ball
7,503,083 B2 3/2009 Ball
7,624,759 B1 12/2009 Ismert et al.
8,028,357 B2 10/2011 Ball
8,166,584 B2 5/2012 Ball
8,302,220 B2 11/2012 Ball
8,321,970 B2 12/2012 Ball
(Continued)

OTHER PUBLICATIONS https://www.aaronco.com/2593826/Product/—retrieved on Oct. 10, 2022 (3 pages).

*Primary Examiner* — Benjamin R Shaw

(57) ABSTRACT

Shower drain assemblies and their components are disclosed. In examples, a shower drain assembly may include a receptor, a threaded flange, an optional hair strainer, a plate, and a protective cover. The receptor may include an upper portion and a lower portion. A portion of a threaded flange is receivable into the upper portion. An internal diameter of the lower portion may be less than any internal diameter of the threaded portion. A membrane may be coupled to an interior cavity of the threaded flange for pressure testing the drain assembly. The threaded flange may also include a tab to facilitate coupling of the threaded flange to the receptor and/or securing of a hair strainer inside the interior cavity of the threaded flange. A top surface of the threaded flange may include an inset to facilitate removal of a plate. The protective cover may protect the plate from damage.

20 Claims, 10 Drawing Sheets

(56) References Cited

U.S. PATENT DOCUMENTS

| | | | | |
|---|---|---|---|---|
| 8,505,132 | B2 | 8/2013 | Ball | |
| 9,074,358 | B2 | 7/2015 | Ball et al. | |
| 9,157,220 | B2 | 10/2015 | Ball et al. | |
| 9,200,436 | B2 | 12/2015 | Ball | |
| 9,663,930 | B2 | 5/2017 | Ball | |
| 10,329,752 | B2 | 6/2019 | Ball | |
| 10,513,841 | B1 * | 12/2019 | Robillard | E03C 1/244 |
| 10,563,385 | B1 | 2/2020 | Ball et al. | |
| 2009/0007321 | A1 * | 1/2009 | Kang | E03C 1/282 4/292 |
| 2017/0130435 | A1 * | 5/2017 | Sebolt | E03C 1/2302 |
| 2019/0167043 | A1 * | 6/2019 | Beck | A47K 1/14 |

* cited by examiner

SHOWER DRAIN AND PROTECTIVE COVER

INTRODUCTION

Water receptacles, such as showers, generally include a drain port located at their lowermost point. The drain port is interconnected to a drain pipe through which wastewater flows. Drain components connect the drain pipe with aesthetic fixtures to contribute to the look and feel of a bathroom. During installation of drain components, a pressure test is performed to determine if the components have formed a proper seal about the drain pipe. Additionally, to establish a proper seal, torque is often applied to various drain components using one or more tools.

It is with respect to this general technical environment that aspects of the present technology disclosed herein have been contemplated. Furthermore, although a general environment is discussed, it should be understood that the examples described herein should not be limited to the general environment identified herein.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Among other things, aspects of the present disclosure include systems for a shower drain. Aspects disclosed herein include a shower drain assembly. The shower drain assembly includes a receptor and a threaded flange. The receptor includes an upper portion a lower portion couplable to a drain pipe. The threaded flange includes a flange with a top surface and a threaded portion extending orthogonal to the flange opposite the top surface, the threaded portion configured to thread into the upper portion of the receptor. The threaded flange also includes an interior cavity inside the threaded portion extending in a direction orthogonal and opposite the top surface. Additionally, the threaded flange includes a ridge inside the interior cavity extending in a direction parallel with the top surface. The threaded flange further includes a membrane coupled to a bottom surface of the ridge opposite the top surface, and wherein the membrane is configured to sustain a pressure to test a seal of a shower drain assembly.

In examples, the ridge of the threaded flange is positioned in a middle two thirds of the interior cavity. In another example, the membrane of the threaded flange is coupled to the ridge via a sonic weld. In a further example, a cavity internal diameter of the interior cavity of the threaded flange is greater than a receptor internal diameter of the lower portion of the receptor. In yet another example, a direction of the sonic weld is aligned with a direction of the pressure to test the seal of the shower drain assembly. In still a further example, the membrane of the threaded flange is de-couplable from the ridge by exerting a force in a direction opposite the direction of the sonic weld. In another example, the membrane of the threaded flange is less than 3 mm in thickness and is composed of a flexible elastomer.

Another aspect described herein includes a threaded flange for a shower drain assembly. The threaded flange includes a flange with a top surface. The threaded flange also includes an interior cavity with an internal diameter, the interior cavity extending in a direction orthogonal and opposite the top surface. Additionally, the threaded flange includes a ridge inside the interior cavity extending in a direction parallel with the top surface. The threaded flange further includes two or more tabs protruding into the interior cavity and extending between the top surface and the ridge.

In an example, the two or more tabs each include a vertical tab surface orthogonal to the top surface, wherein the vertical tab surface is configured to sustain an orthogonal force to cause rotation of the threaded flange. In another example, the vertical tab surface is configured to receive a handle of a tool at each of the two or more tabs. In a further example, the ridge and the two or more tabs are positioned in an upper half of the interior cavity proximate the top surface. In yet another example, the two or more tabs are configured to align with two or more recesses of a hair strainer. In still a further example, the top surface includes at least one inset. In another example, at least one inset is configured to facilitate removal of a fixture abutting the top surface and coupled to the threaded flange. In a further example, the threaded flange further includes: a membrane positioned parallel to the top surface, wherein an edge of the membrane is coupled to the ridge.

A further aspect described herein includes a shower drain assembly. The shower drain assembly includes a receptor, a threaded flange, a plate, and a protective cover. The receptor may be positionable below a shower pan, with the receptor including internal threads. The threaded flange is positionable above the shower pan. The threaded flange includes external threads, an interior cavity, a ridge, tabs, and a membrane. The ridge is in the interior cavity extending into the interior cavity. The tabs are in the interior cavity to rotationally tighten the external threads of the threaded flange into the internal threads of the receptor. The membrane may be sonically welded to the ridge. The plate of the shower drain assembly includes drainage holes and stiff tabs configured to frictionally fit into the interior cavity of the threaded flange. The protective cover of the shower drain assembly obscures the plate. The protective cover includes flexible tabs configured to frictionally fit into one or more drainage holes of the plate and a lip configured to overlap an edge of the plate.

In an example, the protective cover is a flexible elastomer. In another example, the flexible tabs of the protective cover are spaced radially about the protective cover. In a further example, the shower drain assembly further includes a hair strainer, wherein the hair strainer includes recesses configured to align with the tabs of the threaded flange. In yet another example, the threaded flange further includes a flange with a top surface opposite the interior cavity and wherein the top surface includes insets that, when the plate is frictionally coupled to the threaded flange, facilitate decoupling of the plate from the threaded flange.

It is to be understood that both the foregoing general description and the following Detailed Description are explanatory and are intended to provide further aspects and examples of the disclosure as claimed.

BRIEF DESCRIPTION OF THE DRAWINGS

The following drawing figures, which form a part of this application, are illustrative of aspects of systems and methods described below and are not meant to limit the scope of the disclosure in any manner, which scope shall be based on the claims.

Figure 1A:
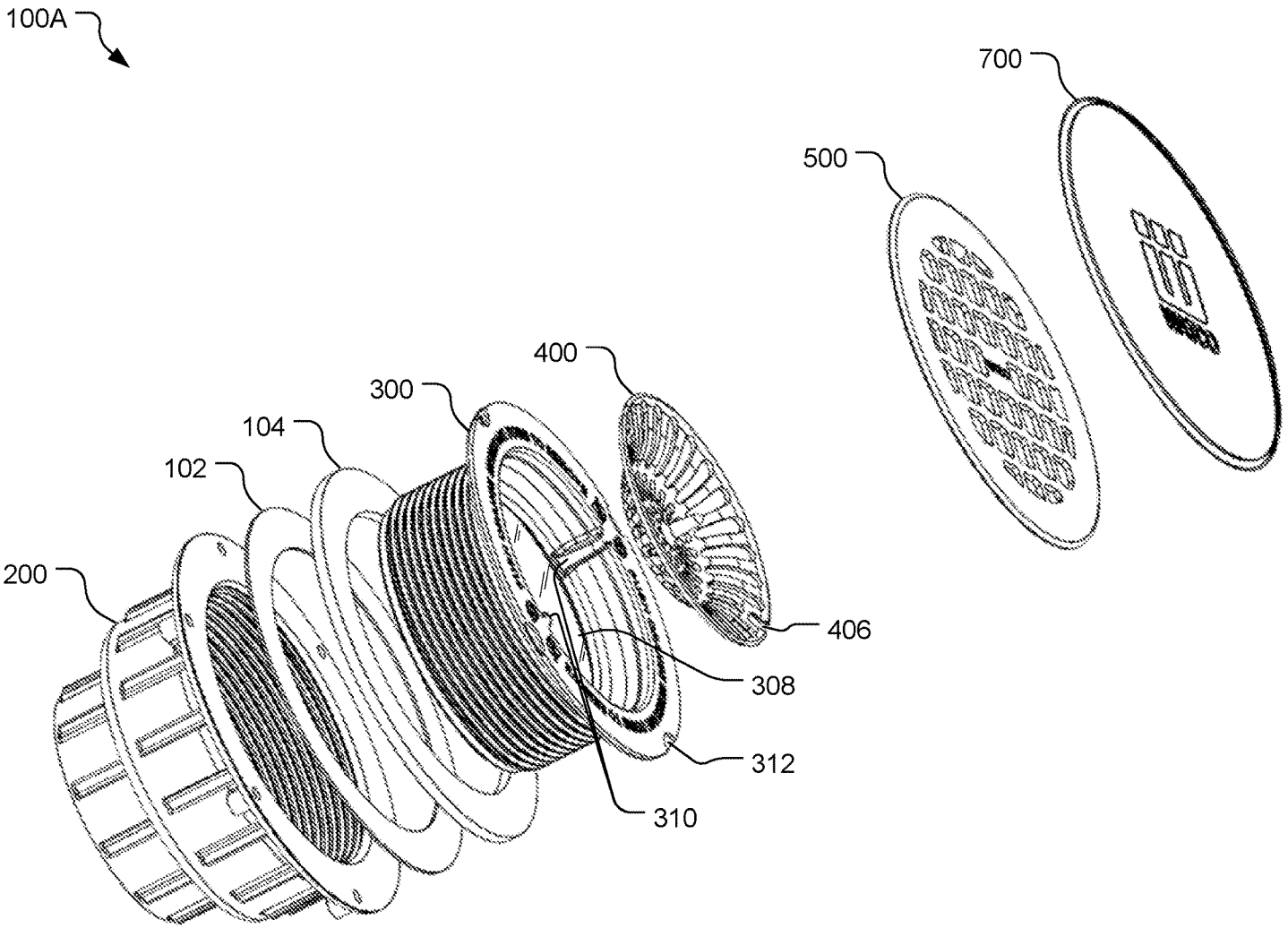
FIGS. 1A-1B show diagrams illustrating a shower drain assembly with multiple components.

While examples of the disclosure are amenable to various modifications and alternative forms, specific aspects have been shown by way of example in the drawings and are described in detail below. The intention is not to limit the scope of the disclosure to the particular aspects described. On the contrary, the disclosure is intended to cover all modifications, equivalents, and alternatives falling within the scope of the disclosure and the appended claims.

DETAILED DESCRIPTION

As discussed briefly above, water receptacles, such as showers, generally include a drain port located at their lowermost point. The drain port is interconnected to a drain pipe or piping through which wastewater flows. During installation of drain components, a pressure test is performed to determine if the components have formed a proper seal about the drain pipe. Additionally, to establish a proper seal, torque is often applied to various drain components using one or more tools. Certain components may be replaced over time.

In particular, after a drain assembly is installed, the drain assembly may be pressure-tested to determine if the components of the drain assembly are properly sealed. In some situations, a membrane is used to perform this test. Some membranes are insertable into the assembly and others may be pre-coupled to components of the assembly. Placement of the membrane too deep in the assembly, however, may compromise the membrane by exposing the membrane to primers or glues. Additionally, placement of the membrane too deep in the assembly may also increase a risk that the membrane is dropped into the drain pipe when being removed. Additionally, membranes that are insertable after installation may not prevent debris from falling into the drain pipe during and after installation and prior to pressure testing. Regarding membranes that are pre-coupled to components of the assembly, depending on the surface area of the membrane and/or the minimum pressure to be exerted on the membrane during a pressure test, the membrane may not be able to withstand forces exerted on the membrane during a pressure test.

Additionally, coupling and decoupling of components of a drain assembly may require specialized tools, may risk damage to a component, and/or may generally be challenging for the installer. For example, applying rotational torque to a drain assembly component to secure the component about a shower pan may require a specialized tool for each brand or type of product. Additionally, outward-facing fixtures that are coupled to the drain assembly may be difficult to remove without scratching or otherwise damaging the aesthetic of the fixture. Moreover, these fixtures are subject to damage and scratching after installation of the drain assembly from the surrounding environment.

Among other things, the technologies disclosed herein address these circumstances by providing the below-discussed drain assembly and its components. In particular, the present technology describes functional design and placement of a membrane within a drain assembly, tab(s) to facilitate tightening of drain assembly components using general tools, inset(s) to facilitate decoupling of some components of the drain assembly, and a protective cover for fixtures of the drain assembly, among other features. With these concepts in mind, drain assemblies and their components are discussed below.

Figure 1B:
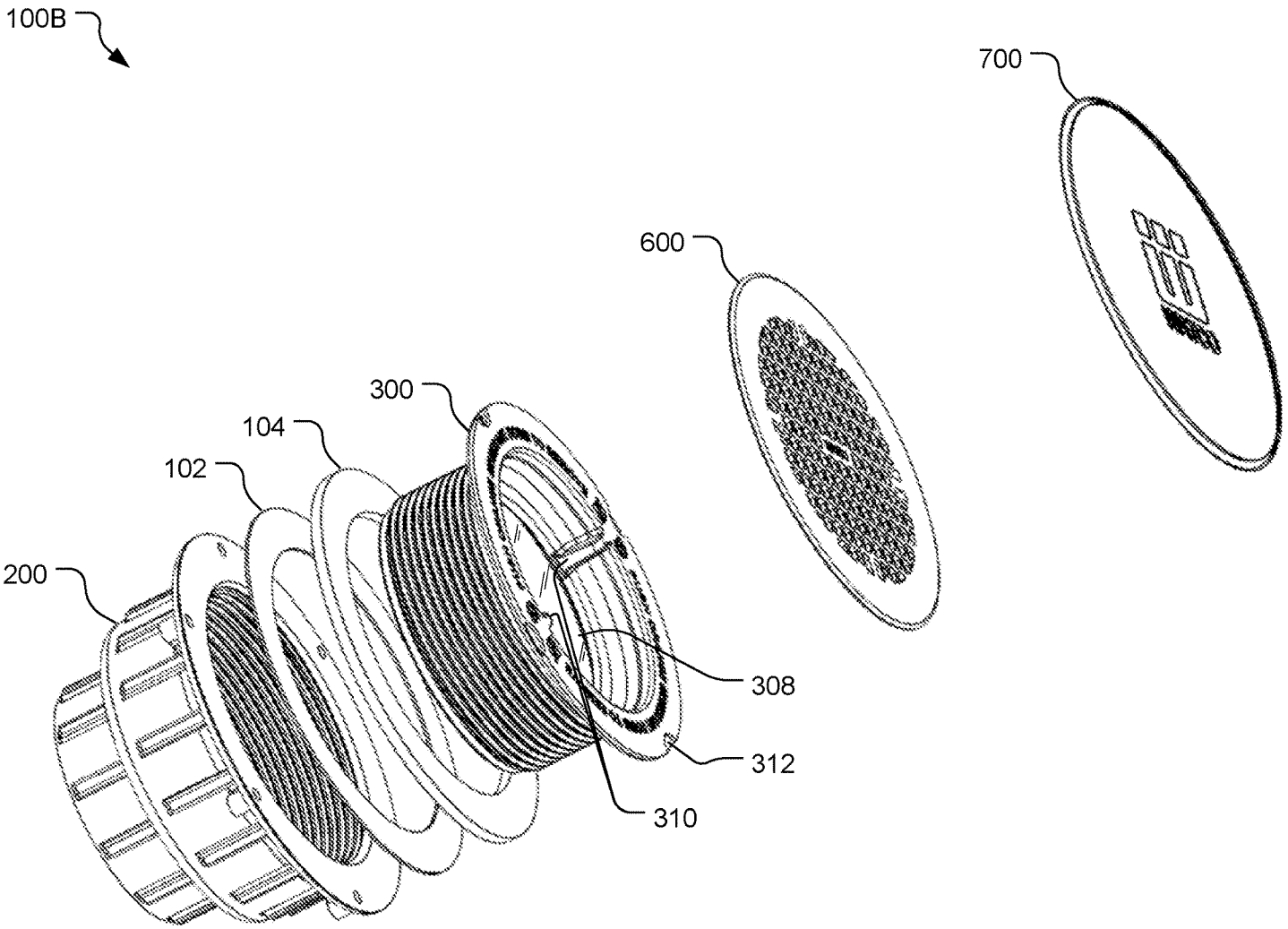

FIGS. 1A-1B show diagrams illustrating a drain assembly 100A, 100B with multiple components. Some of the components shown in FIGS. 1A-1B are discussed in further detail in FIGS. 2A-7D. In the examples shown, the drain assembly 100A, 100B is configured to be secured about a shower pan. Shower pans may be composed of a variety of materials, such as plastic or metal. Design modifications to the disclosed systems may also be made to adapt the drain assembly 100A, 100B to be secured about a tile shower or other securing surface other than a shower pan.

With reference to FIG. 1A, a drain assembly 100A is illustrated that includes a receptor 200, a friction gasket 102, a compressible seal 104, a threaded flange 300, a hair strainer 400, a plate 500, and a protective cover 700. When assembled, the components of the drain assembly 100A are secured relative to each other and a shower pan and/or a drain pipe.

The receptor 200, further described with respect to FIGS. 2A-2D, is configured to couple to a drain pipe constructed from a material such as plastics polyvinyl chloride (PVC) or acrylonitrile butadiene styrene (ABS). A friction gasket 102 and a compressible seal 104 are positioned between the receptor 200 and a bottom side of a shower pan.

The friction gasket 102 is composed of an elastomeric material, such as PVC and/or ABS. In an example, the friction gasket 102 may have a thickness less than 3 mm, less than 2 mm, or less than 1 mm. In a specific example, the friction gasket 102 may have a thickness of approximately 0.020 inches +/-0.003 inches. The friction gasket 102 may provide a friction barrier between the receptor 200 and the compressible seal 104 to mitigate friction on the compressible seal 104 when the receptor 200 moves or rotates. For example, the friction gasket 102 may be rotatable relative to the receptor 200. Continuing this example, when tightening or securing components of the drain assembly 100A about a shower pan, the friction gasket 102 may reduce bunching and/or pinching of the compressible seal 104 by reducing friction between the receptor 200 and the compressible seal 104. Thus, the friction gasket 102 aids in maintaining the integrity of the compressible seal 104 for proper sealing of the drain assembly about a shower pan.

The compressible seal 104 may be constructed of a compressible material, such as rubber. The material of the compressible seal 104 provides a water-tight seal between the receptor 200 and the shower pan when the drain assembly 100A is secured to the shower pan. The compression of the material of the compressible seal 104, when compressed against a shower pan, also provides a frictional force to secure the drain assembly 100A about the shower pan.

The threaded flange 300, further described with respect to FIGS. 3A-3H, feeds through the top of the shower pan (e.g., via a drain port) and secures to the receptor 200. In the example shown, the threaded flange 300 tightens about a shower pan by threading into the receptor 200. A flange 302 of threaded flange 300 frictionally secures to the top of the shower pan. The threaded flange 300 includes at least one tab 310, at least one inset 314, and a removable membrane 316. The membrane 316 may be composed of the same material as the friction gasket 102. The threaded flange 300, as well as the tab 310, the inset 314, and the membrane 316, are further discussed below.

The hair strainer 400, further described with respect to FIGS. 4A-4D, may be positioned inside the threaded flange 300. Although the hair strainer 400 is shown as a component of the drain assembly 100A in FIG. 1A, the hair strainer 400 is an optional component of the drain assembly 100A. The hair strainer 400 includes at least one tab recess 406 that may align with the at least one tab 310 of the threaded flange 300. Additionally, an upper lip 408 of the hair strainer 400 may be positioned below a top surface 306 of the threaded flange 300 when the hair strainer 400 is installed in the drain assembly 100A.

The plate 500, further described with respect to FIGS. 5A-5E, may be frictionally coupled to the threaded flange 300. When the plate 500 is secured to the threaded flange 300, the hair strainer 400, if included in the drain assembly 100A, is retained between the threaded flange and the plate 500. The plate 500 may partially or completely obscure the top surface of the threaded flange 300 when coupled. The plate 500 may be composed of a stiff material, such as stainless steel. The insets 314 on the threaded flange 300 may facilitate de-coupling of the plate 500 from the threaded flange 300 (e.g., to access the hair strainer 400). For example, a flat lever (e.g., a flathead screw driver or other flat, stiff tool) may be inserted into the inset 314 and used to apply an upward force onto a bottom surface 506 of the plate 500, above the top surface 306 of the threaded flange 300.

The protective cover 700, further described with respect to FIGS. 7A-7D, may frictionally secure to the plate 500. The protective cover 700 may be composed of a flexible polymer or other material that facilitates coupling and decoupling of the protective cover 700 to the plate 500. Additionally, the protective cover 700 may partially or completely obscure the plate 500 when the plate 500 is coupled to the threaded flange 300.

Turning to FIG. 1B, a drain assembly 100B is illustrated without a hair strainer 400. In the example shown in FIG. 1B, the drain assembly 100B includes the receptor 200, the friction gasket 102, the compressible seal 104, the threaded flange 300, a plate 600, and the protective cover 700. The plate 600 in this example may be designed differently from plate 500 in FIG. 1A and may facilitate hair-catching in lieu of a separate hair strainer (e.g., hair strainer 400). Thus, in FIG. 1B, the coupling and/or stacking of components in the drain assembly 100B is the same, other than the plate 600 replacing the combination of the hair strainer 400 and the plate 500. In other examples (not shown), the drain assembly 100B may include the plate 600 and the hair strainer 400. The receptor 200 connects to piping below a shower pan, with the friction gasket 102 and compressible seal 104 positioned between the receptor 200 and the bottom of the shower pan. The threaded flange 300 threads into the receptor 200 from the top side of the shower pan to secure the receptor 200, the friction gasket 102, the compressible seal 104, and the threaded flange 300 about the shower pan, relative to each other. The plate 600 includes tabs (described in further detail in FIGS. 6A-6E) that friction fit into an internal diameter of the threaded flange 300 opposite the receptor 200. The protective cover 700 frictionally secures to the plate 600 to cover at least a portion of the exposed surface of the plate 600 after the plate is secured to the threaded flange 300.

FIGS. 2A-7D show various perspective views of the components described above with respect to the drain assemblies 100A, 100B of FIGS. 1A-1B.

Figure 2C:
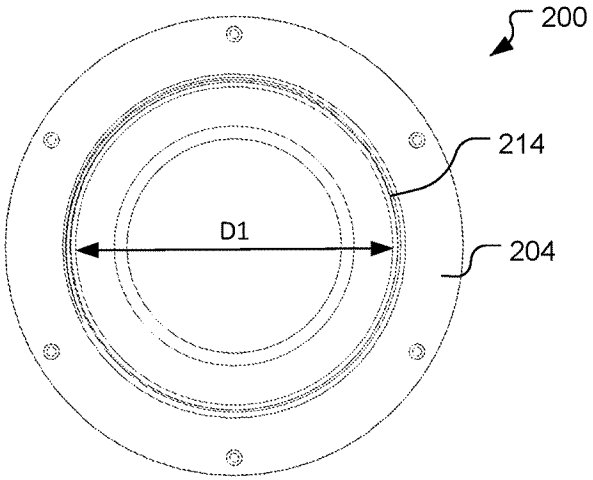
FIGS. 2A-2D show different perspective views of a receptor for the drain assembly of FIGS. 1A-1B.
Figure 2D:
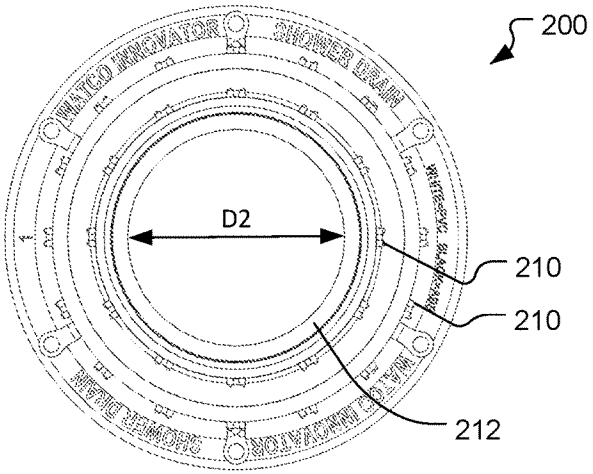
Figure 2A:
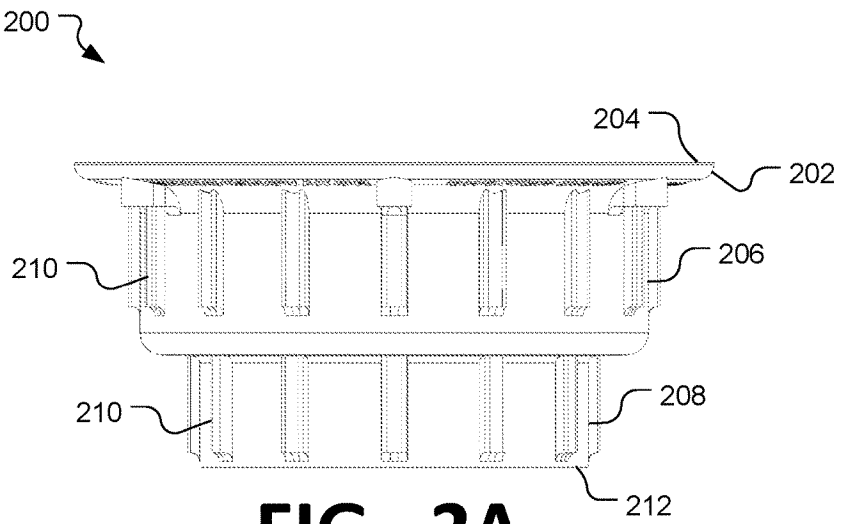
Figure 2B:
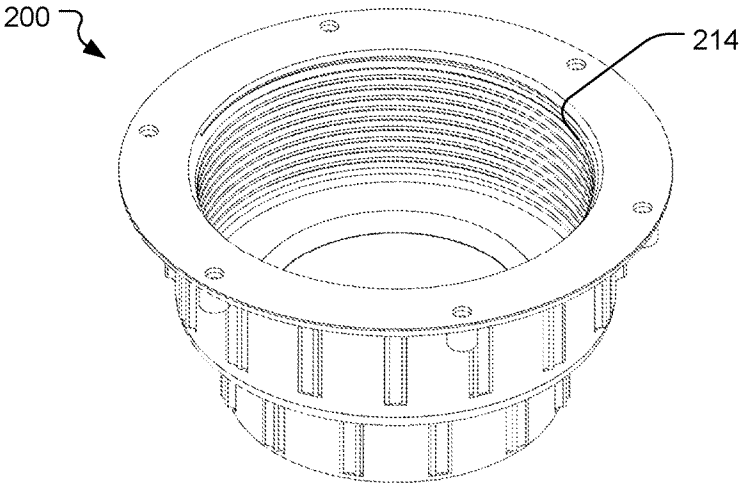

Referring to FIGS. 2A-2D, different views of the receptor 200 for the drain assembly 100A, 100B of FIGS. 1A-1B are shown. FIG. 2A shows a side view of the receptor 200, FIG. 2B shows a perspective view of the receptor 200, FIG. 2C shows a top-down view of the receptor 200, and FIG. 2D shows a bottom-up view of the receptor 200. As described herein, the receptor 200, when the drain assembly is secured about a shower pan, is located below the shower pan. The receptor 200 may be composed of a plastic material, such as PVC, ABS, a combination of PVC/ABS, etc.

As shown in FIGS. 2A-2D, the receptor 200 includes a flange 202, a securing surface 204, an upper portion 206, a lower portion 208, external tabs 210, a pipe end 212, and internal threads 214. The receptor 200 is configured to be coupled to a drain pipe at the pipe end 212 and frictionally coupled to a bottom of a shower pan at securing surface 204 (e.g., which frictional coupling may include a friction gasket 102 and compressible seal 104 positioned between the securing surface 204 and the bottom of the shower pan).

The upper portion 206 of the receptor 200 extends below the flange 202 and opposite the securing surface 204. The external diameter of the upper portion 206 is less than the external diameter of the flange 202. The internal diameter D1 of the upper portion 206 includes the internal threads 214. The internal diameter D1 of the upper portion 206 may be the same as the internal diameter of the flange 202.

The lower portion 208 of the receptor 200 extends below the upper portion 206 opposite the flange 202. The external diameter of the lower portion 208 is less than the external diameter of the upper portion 206 and the external diameter of the flange 202. The internal surface of the lower portion 208 may be smooth (e.g., not threaded). The internal diameter D2 of the lower portion 208 may be less than the internal diameter D1 of the upper portion 206. Additionally, the internal diameter D2 of the lower portion 208 may be sized to couple to a drain pipe of a known size (e.g., a 1.5-inch or 2-inch drain pipe).

The external tabs 210 may be positioned along the upper portion 206 and/or the lower portion 208 of the receptor 200. The external tabs 210 protrude outward from an external surface of the upper portion 206 and/or lower portion 208. The external tabs 210 may be configured to engage with one or more tools to secure or hold the receptor 200 during installation.

Although the receptor 200 shown in FIGS. 2A-2D has an upper portion 206 and a lower portion 208 that are centered, an offset design is also appreciated. Additionally, the receptor 200 depicted includes example features and dimensions for assembly about a shower pan. Other features and dimensions are appreciated, such as a height-adjustable receptor 200 for installation about tiling, etc.

Figure 3A:
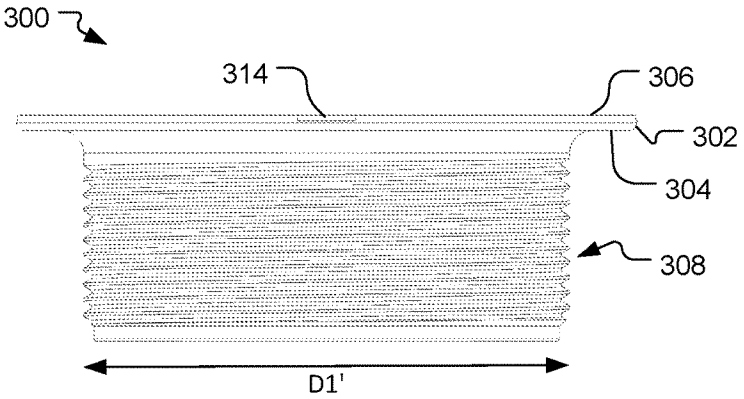
FIGS. 3A-3D show different perspective views of a threaded flange for the drain assembly of FIGS. 1A-1B.
Figure 3B:
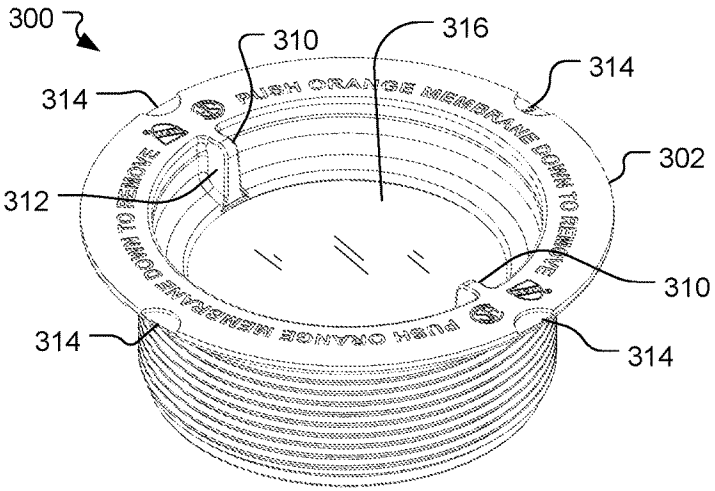
Figure 3C:
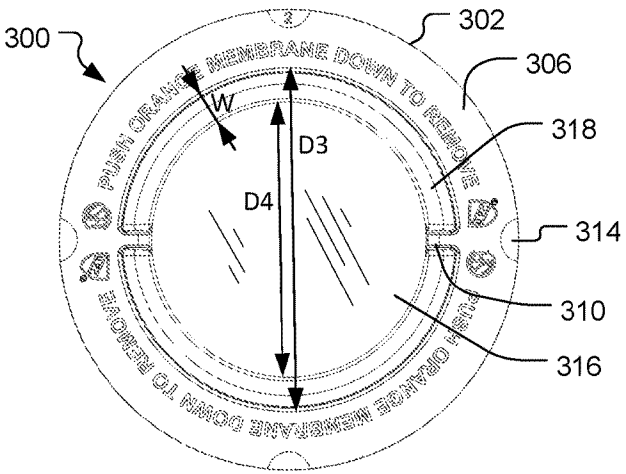
Figure 3D:
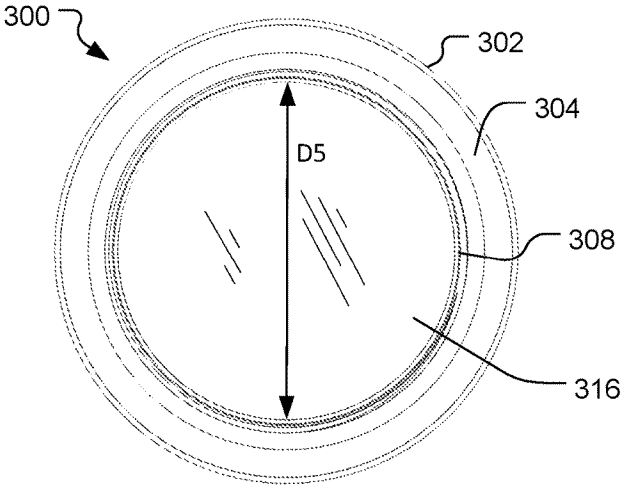

FIGS. 3A-3D show different perspective views of a threaded flange 300 including a membrane 316 for the drain assembly 100A, 100B of FIGS. 1A-1B. FIG. 3A shows a side view of the threaded flange 300, FIG. 3B shows a perspective view of the threaded flange 300 with a membrane 316, FIG. 3C shows a top-down view of the threaded flange 300 with a membrane 316, and FIG. 3D shows a bottom-up view of the threaded flange 300 with a membrane 316.

Figure 3F:
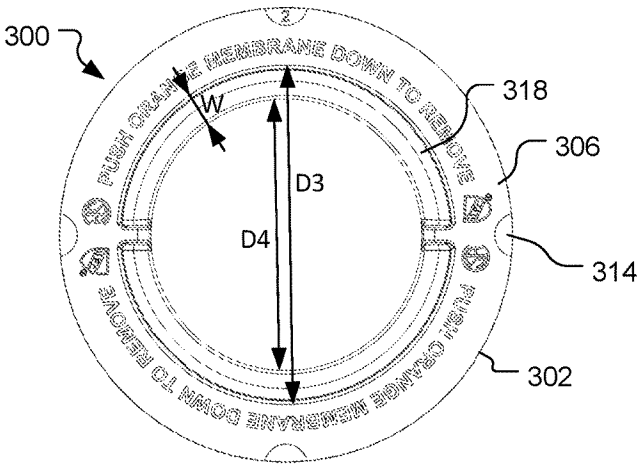
FIGS. 3E-3G show different perspective views of a threaded flange without a membrane for the drain assembly of FIGS. 1A-1B.
Figure 3G:
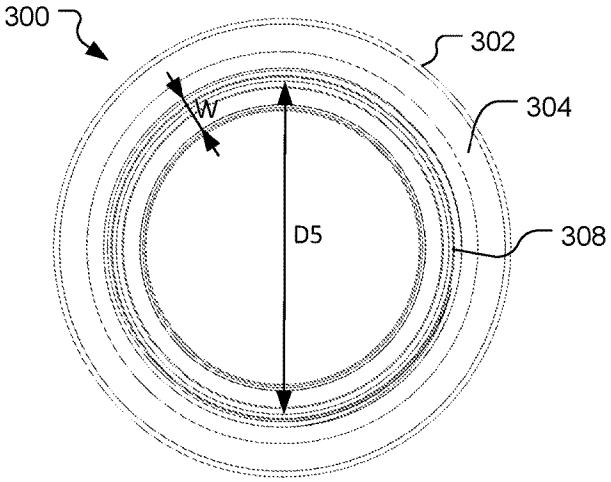
Figure 3E:
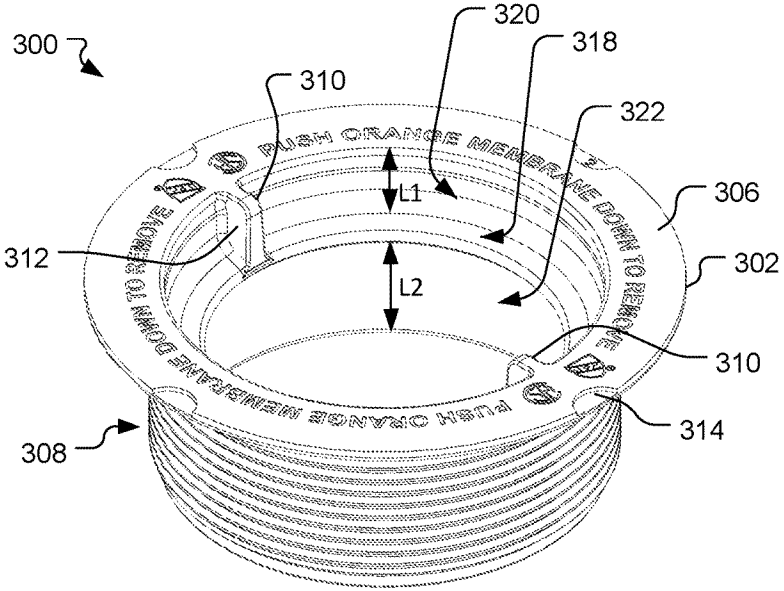

In contrast, FIGS. 3E-3G show perspective views of a threaded flange 300 without the membrane 316 (e.g., after the membrane 316 has been decoupled from the threaded flange 300). FIG. 3E shows a perspective view of the threaded flange 300 without a membrane 316, FIG. 3F shows a top-down view of the threaded flange 300 without a membrane 316, and FIG. 3G shows a bottom-up view of the threaded flange 300 without a membrane 316. As described above, the membrane 316 is a component of the threaded flange 300 until the membrane 316 is removed (e.g., after the threaded flange 300 is pressure tested or as otherwise desired). Additionally, as also described above, at least a portion of the threaded flange 300 is positioned above a shower pan when the drain assembly is secured about the shower pan. The threaded flange 300 may be composed of a rigid material, such as ABS.

As shown in FIGS. 3A-3G, the threaded flange 300 includes a flange 302, a securing surface 304, a top surface 306, a threaded portion 308, tab(s) 310, a vertical tab surface 312, inset(s) 314, a membrane 316 (prior to removal, with no membrane 316 shown in FIGS. 3E-3G), a ridge 318, an upper interior surface 320, and a lower interior surface 322.

When the drain assembly is secured about a shower pan, the securing surface 304 underneath the flange 302 is positioned to exert a force downward onto a top surface of the shower pan. The top surface 306 of the flange 302 is exposed above the shower pan. As shown, the top surface 306 is a ring with an exterior diameter and an interior diameter. Inset(s) 314 in the top surface 306 of the flange 302 may facilitate removal of other drain assembly components (e.g., plates 500, 600) frictionally coupled to the threaded flange 300, as further described below.

A threaded portion 308 of the threaded flange 300 extends from the securing surface 304 downward opposite the top surface 306 of the flange 302. The threaded portion 308 is sized and shaped (e.g., with external thread diameter D1' of the threaded portion 308) to extend through a hole in the shower pan (e.g., a drain port) and thread into the internal threads 214 of the receptor 200 (with internal diameter D1). The threaded portion 308 has an interior cavity that includes an upper interior surface 320 and a lower interior surface 322, separated by a ridge 318. The ridge 318 may extend in a direction that is substantially parallel to the top surface 306, toward a center of the interior cavity of the threaded portion 308. The upper interior surface 320 and the lower interior surface 322 may each be smooth (e.g., unthreaded). The upper internal diameter D3 of the interior cavity that includes the upper interior surface 320 may be the same as the internal diameter of the flange 302. The upper interior surface 320 extends downward from the flange 302, opposite the top surface 306, for an upper length L1 and ends at a ridge 318. The ridge 318 protrudes into the interior cavity of the threaded portion 308 by a width W. At the ridge 318, the ridge internal diameter D4 of the interior cavity is less than upper internal diameter D3. As shown, the ridge internal diameter D4 is less than the upper internal diameter D3 by two times the width W of the ridge (e.g., D3=D4+W+W). The lower internal diameter of the interior cavity that includes the lower interior surface 322 extends downward from the ridge 318, opposite the upper interior surface 320, for lower length L2. The lower internal diameter may be the same as the upper internal diameter D3. The lower length L2 may be greater than the upper length L1, such as at least 1.25 times greater, 1.5 times greater, 2 times greater, etc.). For example, the upper length L1 may be approximately 0.5 inches and the lower length L2 may be approximately 0.9 inches. The ridge 318 may be positioned in the middle two thirds of the internal cavity between the upper length L1 and the lower length L2. Thus, the ridge 318 may be spaced from the top surface 306 (by upper length L1) and spaced from the bottom end of the threaded portion 308 (by lower length L2). The ridge 318 may therefore be positioned completely internal to the interior cavity.

The upper interior cavity also includes tab(s) 310 that extend, in examples, from the top surface 306 of the flange 302 to the ridge 318. The tab(s) 310 protrude radially inward from the upper interior surface 320 into the interior cavity in the same direction as the ridge 318. In an example, the tab(s) 310 protrude into the interior cavity the same width W as the ridge 318. The tab(s) 310 may facilitate stacking or alignment of other drain assembly components, such as a hair strainer 400 further described below.

Further, the tab(s) 310 include a vertical tab surface 312 on each side of any tab 310. The vertical tab surface 312 is substantially orthogonal to the ridge 318 and the top surface 306. The tab(s) 310 may facilitate rotation of the threaded flange 300 to secure to the receptor 200 and thus may facilitate installation of the drain assembly. The vertical tab surfaces 312 of the tab(s) 310 are configured to engage a variety of tools readily available to drain installers. For example, the vertical tab surfaces 312 of the tab(s) 310 are configured to engage handles of a pliers wrench, pliers, or any tool that includes two handles.

Figure 3H:
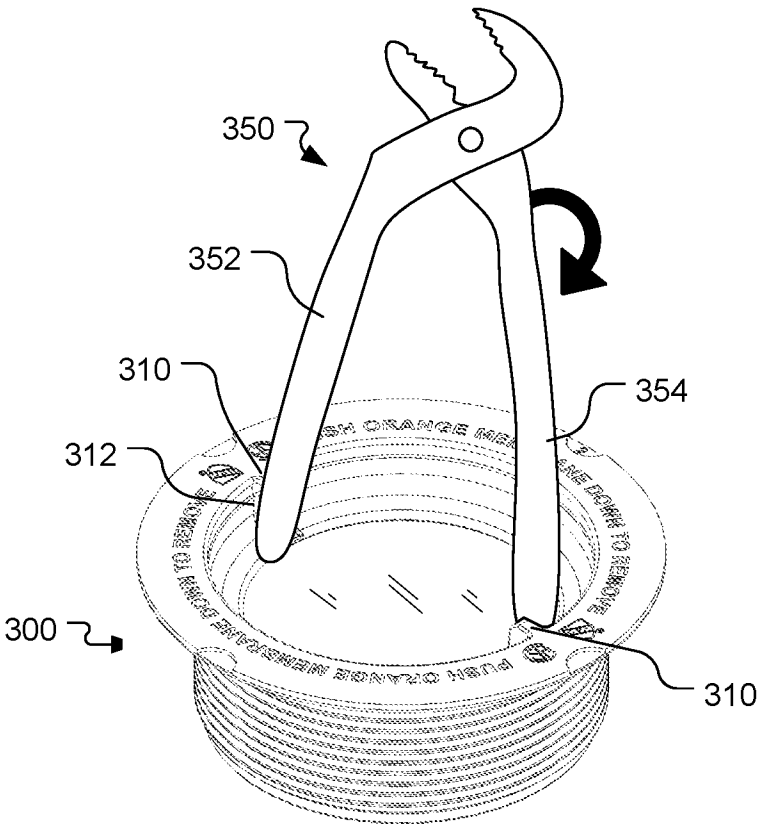
FIG. 3H shows engagement of the tabs of the threaded flange with a tool.

Use of a tool 350 to engage the tab(s) 310 of the threaded flange 300 is shown in FIG. 3H. In FIG. 3H, the tool 350 to engage the tab(s) 310 is a pliers wrench with two handles 352, 354, each engaging a vertical tab surface 312 of two different tabs 310. The tool 350 may be rotated to exert force on the vertical tab surfaces 312 of the tabs 310 to cause rotation of the threaded flange 300. Additional torque may be provided to rotate the tool 350 by using a second tool, such as a screw driver, as a lever to rotate the tool 350. Although two tabs are shown in FIGS. 3A-3H, any number of tabs 310 is appreciated.

The membrane 316 is removably coupled to the threaded flange 300 to facilitate pressure testing of the drain assembly after installation about a shower pan. The membrane 316 may be composed of a flexible or elastomeric material, such as PVC and/or ABS. In an example, the membrane 316 may have a thickness less than 3 mm, less than 2 mm, or less than 1 mm. In a specific example, the friction gasket 102 may have a thickness of approximately 0.020 inches +/-0.003 inches. The composition of the membrane 316 may be the same as the composition of the friction gasket 102 described above. If the membrane 316 and the friction gasket 102 are composed of the same material, both the membrane 316 and the friction gasket 102 may be cut from the same sheet of material during manufacturing. In particular, the membrane 316, having an external diameter D5, may be cut out from a sheet inside the inner diameter of the friction gasket 102, because the inner diameter of the friction gasket 102 is larger than the external diameter D5 of the membrane 316. This manufacturing process may reduce wasted materials and reduce production time.

As described above, the membrane 316 may be coupled to the threaded flange 300. The coupling may secure the membrane to the threaded flange 300 until removal of the membrane is required or desired (e.g., after pressure testing). In examples, the membrane 316 may be coupled to the threaded flange 300 via a variety of mechanisms, such as with friction, with an adhesive, using sonic welding, or other mechanism or combination of mechanisms for coupling the membrane 316 with the threaded flange 300.

Describing an example where a membrane 316 is frictionally coupled to the threaded flange 300, the frictional coupling may be based on a thickness of the membrane. For instance, a membrane 316 of greater thickness may frictionally engage with the threaded flange 300 if the thickness of the membrane 316 provides stiffness sufficient to prevent the membrane 316 from being pushed through the threaded flange 300 during a pressure test.

In a different example, a membrane 316 is coupled to the threaded flange 300 with an adhesive (e.g., liquid, paste, film, tape, etc.). The adhesive may allow for the membrane 316 to decouple from the threaded flange 300 under certain strain. For instance, an adhesive bond between the membrane 316 and the threaded flange 300 may break when a force exceeding a threshold (e.g., a force greater than that applied during a pressure test) is applied to the membrane 316. In another instance, an adhesive bond between the membrane 316 and the threaded flange 300 may weaken or release under a change in temperature (e.g., applying heat). Other strains may be applied to an adhesive to otherwise allow the membrane 316 to be decoupled from the threaded flange 300.

Alternatively, the membrane 316 may be coupled to the threaded flange 300 via sonic welding. During sonic welding, the material of the membrane 316 is solid-state welded with a high-frequency vibratory energy while the welded pieces are held together under pressure. Sonic welding produces a bond between the materials of the two welded components without melting the base material. In the examples provided herein, the two welded components are the membrane 316 and the ridge 318 of the threaded flange 300. Using the examples described herein, the membrane 316 is sonically welded to the ridge 318 with a horn applying a physical force and energy in the form of high-frequency vibrations to the membrane 316 in the direction of the ridge 318. Under the physical force (e.g., pressure) and energy exerted by the horn, the membrane 316 forms a removable weld with the ridge 318 of the threaded flange 300. Aspects of securing a membrane to an overflow system are further described in U.S. Pat. No. 5,890,241, which is incorporated by reference in its entirety. An example of sonic welding of a membrane is also used by the Watco® Innovator® Overflow Elbow product. These examples of sonic welding of a membrane, however, differ in application, placement, and direction of the sonic weld relative to a pressure to be applied to the membrane, as further described, below.

In the examples shown in FIGS. 3A-3D, the membrane 316 is sonically welded to the threaded flange 300 along the edge of the membrane 316 at a bottom surface of the ridge 318 (e.g., the surface of the ridge 318 adjacent the lower interior surface 322 and opposite the upper interior surface 320, the tab(s) 310, and the top surface 306). This positioning of the membrane 316 leaves the upper interior cavity of the threaded flange 300 exposed during assembly (e.g., the upper interior surface 320, the tab(s) 310, and the upper surface of the ridge 318 are exposed when the membrane 316 is coupled to the threaded flange 300 and when the threaded flange 300 is coupled to the receptor 200). Thus, the membrane diameter D5 of the membrane 316 is greater than the ridge diameter D4 and less than or equal to the lower internal diameter (which, in the examples depicted is equal to the upper internal diameter D3), such that the edge of the membrane 316 may completely overlap with the width W of the ridge 318 (e.g., D4<D5<D3=D4+W+W).

Additionally, in the examples depicted, the sonic weld of the membrane 316 and the bottom surface of the ridge 318 is in the direction of the top surface 306 of the threaded flange 300. Thus, the direction of the sonic weld, in these examples, is in the same direction as any pressure to be exerted on the membrane 316 during a pressure test of the drain assembly. Because the direction of the sonic weld and the exerted pressure are aligned in the same direction (upward, toward the top surface 306 of the threaded flange 300), the membrane 316 can withstand higher pressures and/or the membrane 316 can be used to test relatively large diameters with greater membrane surface area. In the examples depicted herein, the ridge diameter D4, which is the diameter subject to any pressure testing, is relatively large (e.g., has a diameter greater than two inches or is at least 2.5 inches), such that pressure testing in the same direction as the sonic weld is required or desired. As an alternative to aligning a sonic weld with the direction of a pressure test, a thickness of the membrane 316 may be increased.

Regarding pressure testing of the membrane 316, a different force is applied to the membrane 316 depending on the surface area of the membrane 316. For example, a pressure test of 22 pounds per square inch (PSI) on a 2-inch diameter membrane 316 exerts approximately 69 pounds of force on the membrane 316. Alternatively, the same pressure test of 22 PSI on a 2.5-inch diameter membrane 316 exerts approximately 108 pounds of force on the membrane 316. To sustain greater forces, the membrane 316 may be required or desired to be coupled to the threaded flange 300 on an underside of a lip 318 of the threaded flange 300 (e.g., as shown in FIG. 3D), during a pressure test. In an example, membranes 316 tested at approximately 22 PSI with thicknesses less than 1 mm may be coupled to the underside of the lip 318 when the diameter of the membrane 316 is greater than 2 inches, greater than 2.1 inches, greater than 2.2 inches, greater than 2.3 inches, greater than 2.4 inches, etc.

The membrane 316 can be removed from the threaded flange 300 (e.g., after pressure testing the installed drain assembly) with a force opposite the direction of the coupling (e.g., friction, adhesive, sonic weld, etc.). In the example shown, the membrane 316 may be removed with a force in a downward direction toward the lower interior cavity of the threaded portion 308 of the threaded flange 300 (e.g., a force opposite the top surface 306 of the threaded flange 300 and toward a base of the threaded flange 300). If the membrane is removed when the drain assembly is installed, a downward force onto the membrane 316 may release the coupling (e.g., friction, adhesive, sonic weld, etc.) and the membrane 316 may fall into the lower interior cavity of the threaded flange 300 or into an interior cavity of the receptor 200. The membrane 316 may be prevented from falling into a coupled drain pipe by the receptor 200, because the membrane diameter D5 is larger than the internal diameter D2 of the lower portion 208 of the receptor 200. A membrane 316 that is no longer coupled to the threaded flange 300 may be grasped and removed from the drain assembly with a tool, such as pliers, or by hand.

The placement and coupling of the membrane 316 for the drain assembly thus includes the following summary of features. The membrane 316 may be coupled to the threaded flange 300 via sonic welding. The sonic weld may be in the same direction as a pressure test applied to the drain assembly. Because the sonic weld is in the direction of applied pressure, the membrane 316 can withstand higher pressures and/or larger surface areas to which pressure is applied. The membrane 316 is coupled to the threaded flange 300 at a ridge 318 in an interior cavity of the threaded flange 300. The ridge 318 and the membrane 316 are positioned away from a pipe end 212 of the receptor 200, when the drain assembly is installed and the threaded flange 300 is coupled to the receptor 200. This placement of the membrane 316 inside the interior cavity of the threaded flange 300 reduces a likelihood that PVC primer and/or PVC glue, used in coupling the receptor 200 with a drain pipe, contacts the membrane 316. Contact with PVC primer and/or PVC glue may be detrimental to the integrity of the membrane 316 and may otherwise compromise the membrane 316 in such a way to cause the membrane 316 to malfunction during a pressure test.

Figure 4C:
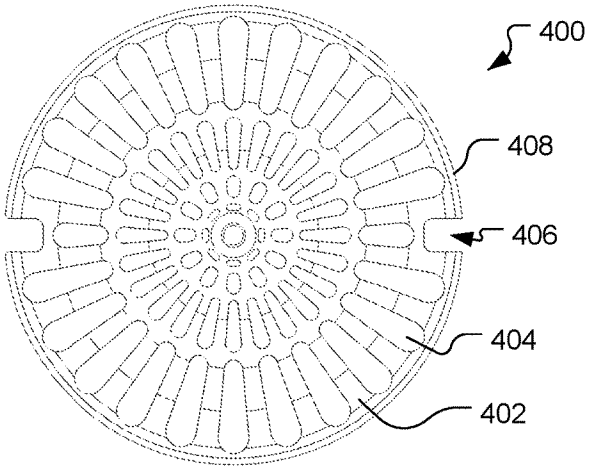
FIGS. 4A-4D show different perspective views of a hair catcher for the drain assembly of FIG. 1A.
Figure 4D:
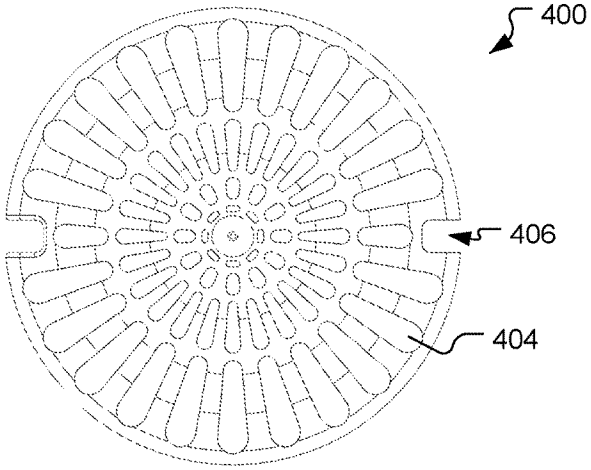
Figure 4A:
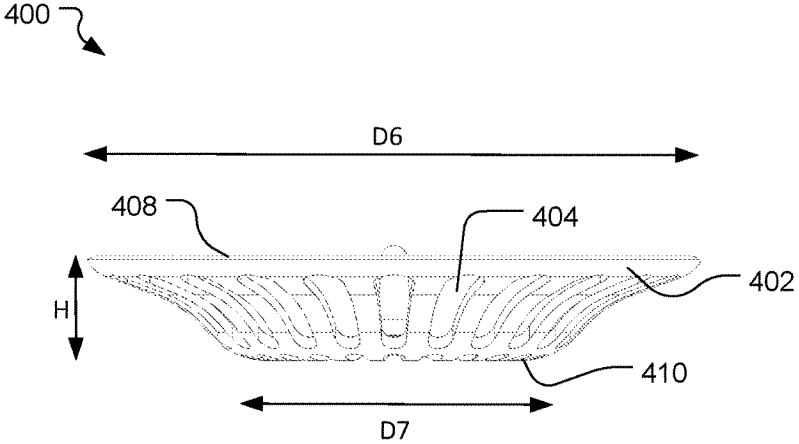
Figure 4B:
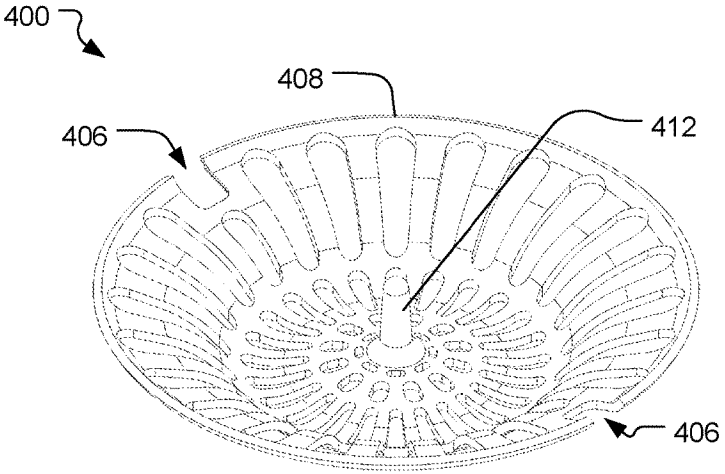

FIGS. 4A-4D show different perspective views of a hair strainer 400 for the drain assembly 100A of FIG. 1A. FIG. 4A shows a side view of the hair strainer 400, FIG. 4B shows a perspective view of the hair strainer 400, FIG. 4C shows a top-down view of the hair strainer 400, and FIG. 4D shows a bottom-up view of the hair strainer 400.

The hair strainer 400, as shown, includes a body 402, drainage holes 404, at least one tab recess 406, an upper lip 408, a base 410, and a protrusion 412. The hair strainer 400 may be an optional component of the drain assembly. Additionally, the hair strainer 400 may be configured to be dropped inside an interior cavity of the threaded flange 300 above the ridge 318. Thus, the hair strainer 400 is removable from the drain assembly (e.g., for cleaning, replacement, etc.). The at least one tab recess 406 of the hair strainer 400 is configured to engage the at least one tab 310 of the threaded flange 300 to position the hair strainer 400 inside of the threaded flange 300. The hair strainer 400 may gravitationally secure to the threaded flange 300. Additionally, the hair strainer 400 may be separate and independent from a plate 500, 600 of the drain assembly. For example, the hair strainer 400 may not couple or secure to a plate 500, 600. Stated alternatively, the hair strainer 400 may gravitationally couple only to the threaded flange 300 and no other component of the drain assembly.

When coupled to the threaded flange 300, the upper lip 408 of the hair strainer 400 is positioned below the flange 302 of the threaded flange 300. In an example, a portion of the body 402 of the hair strainer 400 rests on the ridge 318 of the threaded flange 300, inside the interior cavity of the threaded flange 300. Thus, the strainer upper diameter D6 at the upper lip 408 of the hair strainer 400 may be the same or less than the upper internal diameter D3 of the interior cavity of the threaded flange 300. Additionally, the strainer lower diameter D7 at the base 410 of the hair strainer 400 may be the same or less than the ridge diameter D4 of the interior cavity of the threaded flange 300. A height H of the hair strainer 400 may be the same or less than the lower interior length L2 of the lower interior surface 322 of the threaded flange 300 so as to fully rest inside the interior cavity of the threaded portion 308 of the threaded flange 300 (e.g., after the membrane 316 is removed).

The body of the hair strainer 400 includes the upper lip 408, the base 410, and the protrusion 412. Cutouts from the body 402 include tab recess(es) 406 and drainage holes 404. The body of the hair strainer 400 may be composed of a durable, cleanable, and/or disposable, lightweight material, such as plastic. The diameter of the upper lip 408 is greater than the diameter of the base 410. As shown, the body 402 curves from the upper lip 408 inward toward the base 410. A protrusion 412 may protrude from the base 410 upward toward the upper lip 408.

The drainage holes 404 of the hair strainer 400, may be shaped and sized to facilitate drainage while catching hair and debris. The drainage holes 404 may include a variety of shapes and sizes, depending on their location about the body 402 of the hair strainer 400. For example, drainage holes 404 near the base of the hair strainer 400 may be smaller (e.g., smaller surface area) than drainage holes 404 near the upper lip 408.

The tab recess(es) 406 are sized and shaped relative to the tab(s) 310 on the threaded flange 300, such that the tab recess(es) 406 fit around the tab(s) 310. The tab recess(es) 406 extend toward the center of the base 410 of the body 402 of the hair strainer 400 from the upper lip 408.

FIGS. 5A-5E and FIGS. 6A-6E show two different plates 500, 600 for the drain assembly 100A, 100B. As further described above with respect to FIGS. 1A-1B, the plate 600 shown in FIGS. 6A-6E may be used in lieu of a combination of a hair strainer 400 and plate 500. This is, in part, due to the difference in drainage holes 604 of the plate 600 in FIGS. 6A-6E as compared with the drainage holes 504 of the plate 500 in FIGS. 5A-5E. Each of the plates 500, 600 shown in FIGS. 5A-5E and 6A-6E may be made of a rigid material, such as stamped, stainless steel, with any finish.

Figure 5A:
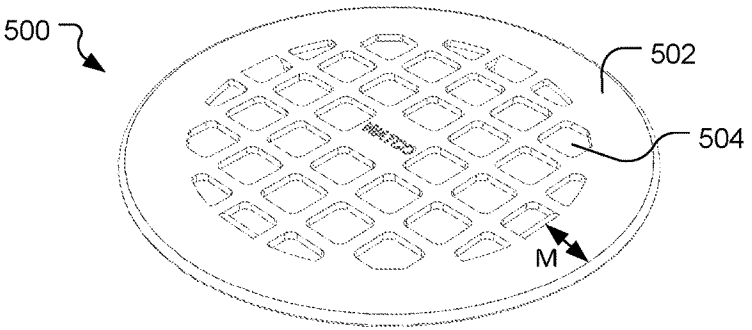
FIGS. 5A-5E show different perspective views of a cover plate for the drain assembly of FIG. 1A.
Figure 5B:
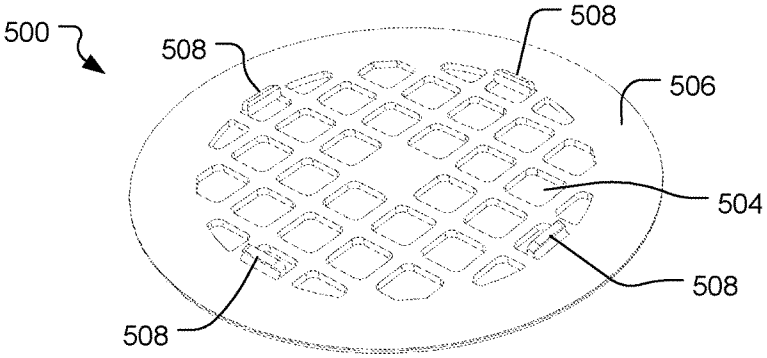
Figure 5C:
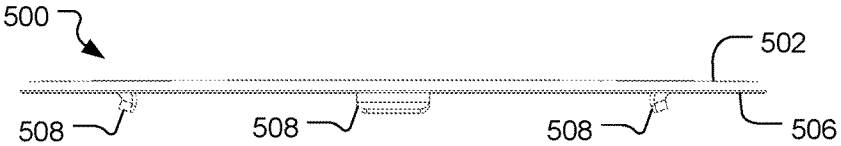
Figure 5D:
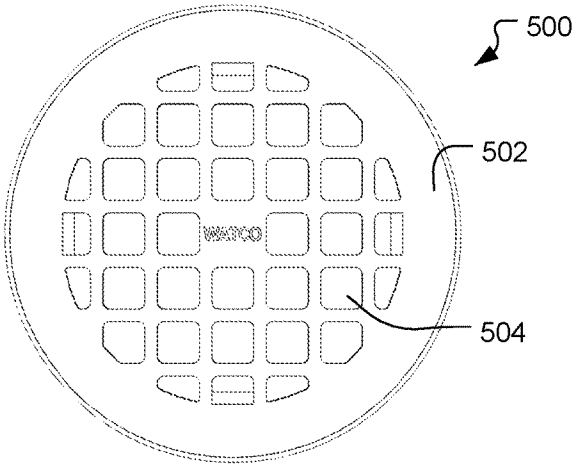
Figure 5E:
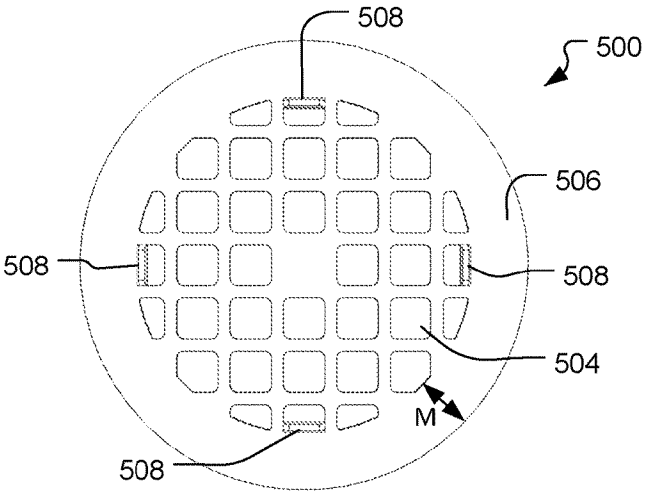

FIGS. 5A-5E show different perspective views of a plate 500 for the drain assembly 100A of FIG. 1A. FIG. 5A shows a top perspective view of the plate 500, FIG. 5B shows a bottom perspective view of the plate 500, FIG. 5C shows a side view of the plate 500, FIG. 5D shows a top-down view of the plate 500, and FIG. 5E shows a bottom-up view of the plate 500.

The plate 500 shown in FIGS. 5A-5E includes a top surface 502, one or more drainage hole(s) 504, a bottom surface 506, and one or more friction tab(s) 508. The plate 500 is shaped and sized relative to the threaded flange 300. In the example shown, the top surface 502 is a circle.

The friction tab(s) 508 are configured to exert an outward force on an upper interior surface 320 of the threaded flange 300. This outward force may result from a shape of the friction tab(s) 508. The friction tab(s) 508 may therefore frictionally couple to the threaded flange 300. Additionally, the bottom surface 506 of the plate 500 is positionable onto the top surface 306 of the threaded flange 300. In the example shown, the friction tab(s) 508 curve away from a center of the plate 500. Although a specific curvature of the friction tab(s) 508 is shown, any shape is appreciated that creates a diameter between two or more friction tabs 508 that is greater than or equal to the diameter D3 of the upper interior surface 320 of the threaded flange 300. The shape and position of the friction tab(s) 508 is relative to the drainage holes 504. The friction tab(s) 508 may be configured to further facilitate draining through the drainage holes 504 by not obstructing the drainage holes 504 (e.g., from a top-down view shown in FIG. 5D). Although FIGS. 5A-5E show a plate 500 with four friction tabs 508, any number of friction tabs 508 is appreciated. The friction tabs 508 may be spaced radially about the bottom surface 506 of the plate 500. Additionally, the friction tabs 508 may be spaced symmetrically about one or more halves of the plate 500.

The drainage holes 504 may be positioned to form a margin M along an edge of the plate 500. The margin M may be symmetric about the plate 500. The margin M may align with the top surface 306 of the flange 302 of the threaded flange 300, when the plate 500 is coupled to the threaded flange 300. For example, the margin M may completely obscure the top surface 306 of the threaded flange 300 when the plate 500 is frictionally coupled to the threaded flange 300. A margin M approximately the length of the flange 302 of the threaded flange 300 may further facilitate drainage by maximizing the surface area through which fluid may drain through the drainage holes 504. Although FIGS. 5A-5E show a plate 500 with 36 drainage holes 504, any number of drainage holes 504 is appreciated (e.g., 50 or less drainage holes, 40 or less drainage holes, 30 or less drainage holes, 20 or less drainage holes, etc.). The drainage holes 504 may be spaced radially or axially about the plate 500. Additionally, the drainage holes 504 may be spaced symmetrically about one or more halves of the plate 500.

Figure 6A:
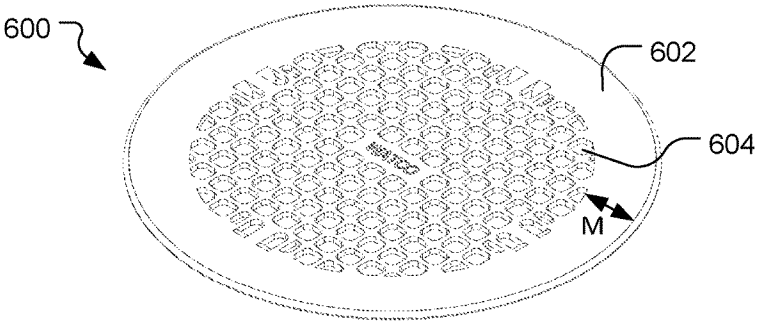
FIGS. 6A-6E show different perspective views of a cover plate for the drain assembly of FIG. 1B.
Figure 6B:
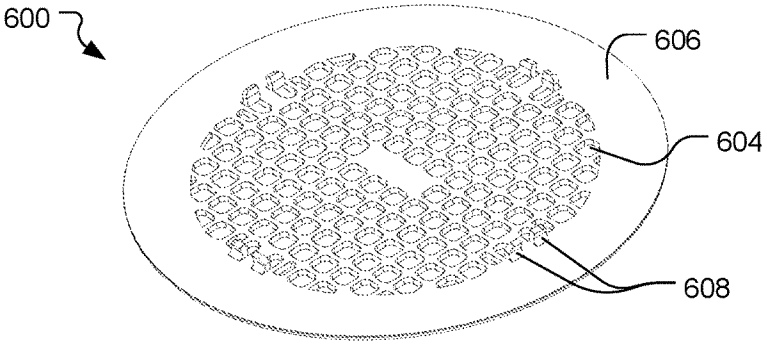
Figure 6C:
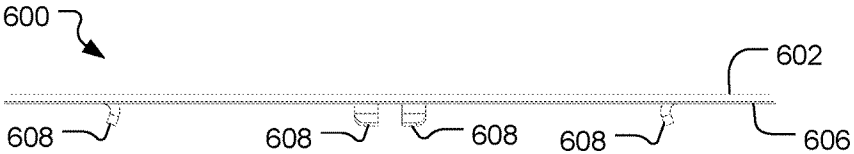
Figure 6D:
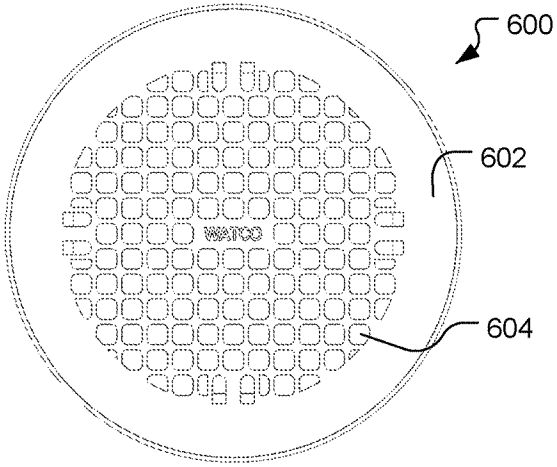
Figure 6E:
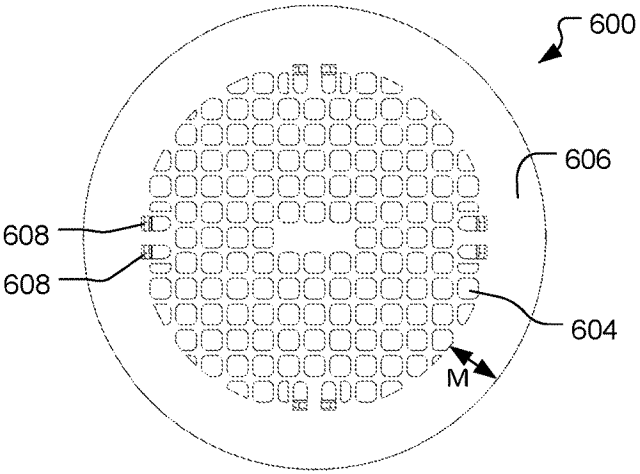

FIGS. 6A-6E show different perspective views of a plate 600 for the drain assembly 100B of FIG. 1B. FIG. 6A shows a top perspective view of the plate 600, FIG. 6B shows a bottom perspective view of the plate 600, FIG. 6C shows a side view of the plate 600, FIG. 6D shows a top-down view of the plate 600, and FIG. 6E shows a bottom-up view of the plate 600.

Similar to the plate 500 described with respect to FIGS. 5A-5E, the plate 600 shown in FIGS. 6A-6E is shaped and sized relative to the threaded flange 300, and includes a top surface 602, one or more drainage hole(s) 604, a bottom surface 606, and one or more friction tab(s) 608.

The friction tab(s) 608 are configured to exert an outward force on an upper interior surface 320 of the threaded flange 300. This outward force may result from a shape of the friction tab(s) 608. The friction tab(s) 608 may therefore frictionally couple to the threaded flange 300. Additionally, the bottom surface 606 of the plate 600 is positionable onto the top surface 606 of the threaded flange 300. In the example shown, the friction tab(s) 608 curve away from a center of the plate 600. Although a specific curvature of the friction tab(s) 608 is shown, any shape is appreciated that creates a diameter between two or more friction tabs 608 that is greater than or equal to the diameter D3 of the upper interior surface 320 of the threaded flange 300. The shape and position of the friction tab(s) 608 is relative to the drainage holes 604. The friction tab(s) 608 may be configured to further facilitate draining through the drainage holes 604 by not obstructing the drainage holes 604 (e.g., from a top-down view shown in FIG. 6D, the friction tab(s) 608 are not visible). Although FIGS. 6A-6E show a plate 600 with eight friction tabs 608, any number of friction tabs 608 is appreciated. The friction tabs 608 may be spaced radially about the bottom surface 606 of the plate 600. Additionally, the friction tabs 608 may be spaced symmetrically about one or more halves of the plate 600. Further, the friction tabs 608 may be positioned in groups (e.g., multiple pairs of friction tabs 608, as shown).

Similar to the plate 500 describe above, the drainage holes 604 may be positioned to form the margin M along an edge of the plate 600, where the margin M may be symmetric about the plate 600. The margin M may align with the top surface 306 of the flange 302 of the threaded flange 300 (e.g., to completely obscure the top surface 306 of the threaded flange 300), when the plate 600 is coupled to the threaded flange 300. Although FIGS. 6A-6E show a plate 600 with 142 drainage holes 604, any number of drainage holes 604 is appreciated (e.g., at least 50 drainage holes, at least 100 drainage holes, at least 150 drainage holes, etc.). The drainage holes 604 may be spaced radially or axially about the plate 600. Additionally, the drainage holes 604 may be spaced symmetrically about one or more halves of the plate 600.

Either plate 500, 600 shown in FIGS. 5A-5E or 6A-6E is couplable to (e.g., via friction tabs 508, 608), and removable from, the threaded flange 300. In an example, the insets 314 on the flange 302 of the threaded flange 300 may facilitate removal or de-coupling of the plate 500, 600 from the threaded flange 300. For example, a flat lever (e.g., flathead screwdriver) may be inserted into the inset 314 of the threaded flange 300 and tilted or rotated to apply a force onto the bottom surface 506, 606 of the plate 500, 600.

The drainage holes 504, 604 of the plates 500, 600 show different configurations with different functions. The drainage holes 504 on the plate 500 shown in FIGS. 5A-5E are larger than the drainage holes 604 on the plate 600 shown in FIGS. 6A-6E. A larger drainage hole 504 facilitates quicker drainage, but allows more debris to pass through the drainage hole. Thus, the relatively smaller drainage holes 604 of the plate 600 shown in FIGS. 6A-6E catch hair and other debris on the top surface 602 of the plate 600 for easy removal, without desiring a separate hair strainer (e.g., hair strainer 400, which may be optionally added to a drain assembly including a plate with larger drainage holes). Smaller drainage holes may be desired in environments where frequent and quick cleaning is desirable (e.g., a hotel).

Figure 7C:
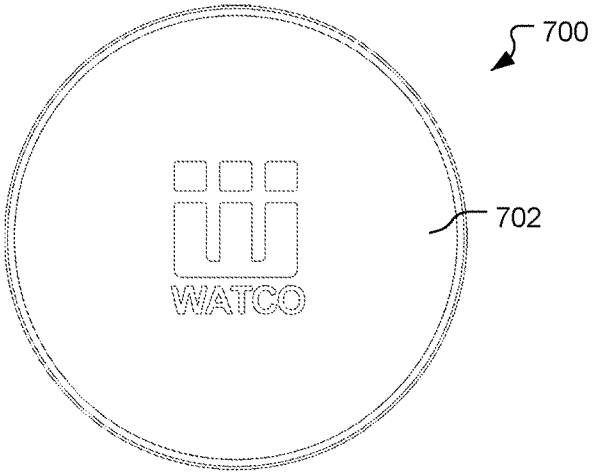
FIGS. 7A-7D show different perspective views of a protective cover for the drain assembly of FIGS. 1A-1B.
Figure 7D:
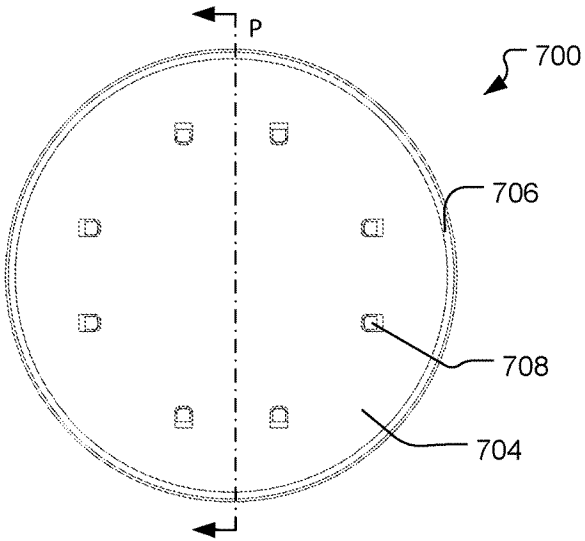
Figure 7A:
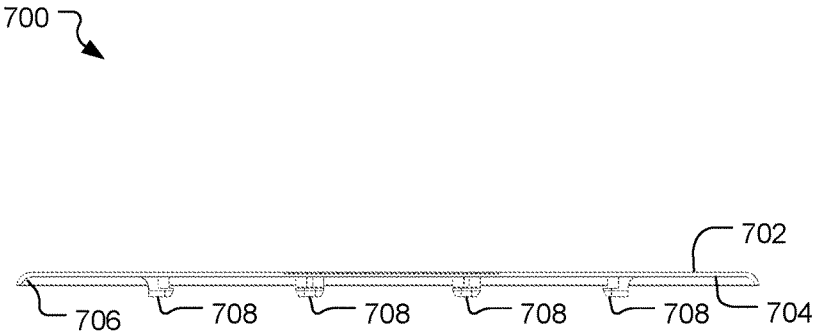
Figure 7B:
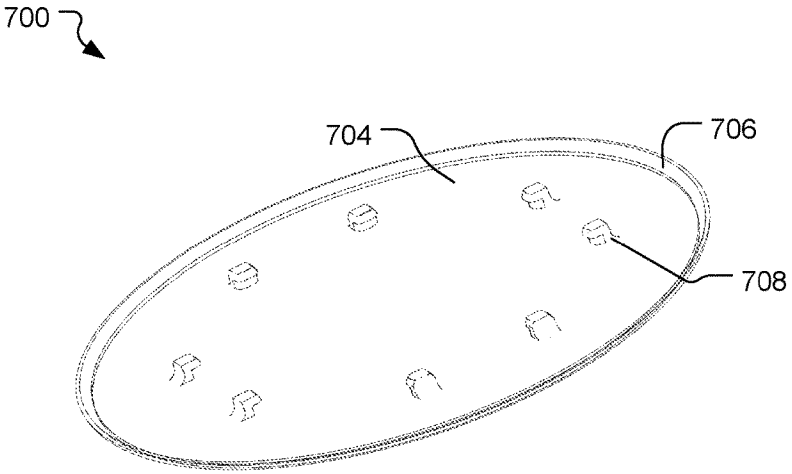

FIGS. 7A-7D show different perspective views of a protective cover 700 for the drain assembly 100A, 100B of FIGS. 1A-1B. FIG. 7A shows a side cross-sectional view at cut plane P of the protective cover 700, FIG. 7B shows a bottom perspective view of the protective cover 700, FIG. 7C shows a top-down view of the protective cover 700, and FIG. 7D shows a bottom-up view of the protective cover 700.

After a drain assembly is installed, the plate (e.g., plate 500 or plate 600) is exposed and subject to wear and tear or damage from the environment. In some instances, the drain assembly may be installed prior to completion of other construction on the premises. A construction environment may increase a likelihood that the plate of the drain assembly is scratched or otherwise damaged, due to airborne particles, direct contact with construction materials, walking-on with work boots of construction workers, etc.

To prevent damage to the plate 500, 600 of an installed drain assembly 100A, 100B, the protective cover may be coupled to the plate 500, 600 to partially or completely obscure the plate 500, 600, thereby protecting the finish of the plate 500, 600. Additionally or alternatively, the protective cover 700 may cover one or more drainage holes 504, 604 of the plate 500, 600 to reducing debris from falling inside the drain assembly 100A, 100B onto the membrane 316 and/or drain pipe (e.g., after removal of the membrane 316). The protective cover 700 may be easily removable and/or discardable, such as at a time when the plate 500, 600 is not exposed to an environment with high risk of damage. In an example, the protective cover may be composed of a plastic or other flexible material. Additionally, the protective cover 700 may be colored (e.g., green) and/or branded.

As shown in FIGS. 7A-7D, the protective cover 700 includes a top surface 702, a bottom surface 704, a lip 706, and at least one friction tab 708. The protective cover 700 is shaped and sized relative to the plate 500, 600. In the example shown, the top surface 702 is a circle with the lip 706 designed to curve around a thickness of the plate 500, 600. The lip 706 may frictionally couple to the plate 500, 600. The bottom surface 704 of the protective cover 700 is positionable onto the top surface 602 of the plate 500, 600. At least one friction tab 708 protrudes from the bottom surface 704 to frictionally engage at least one drainage hole 504, 604 of the plate 500, 600. Although FIGS. 7A-7D show a protective cover 700 with eight friction tabs 708, any number of friction tabs 708 is appreciated. The friction tabs 708 may be spaced radially about the bottom surface 704 of the protective cover. Additionally, the friction tabs 708 may be spaced symmetrically about one or more halves of the protective cover 700. The friction tabs 708 may protrude from the bottom surface 704 of the protective cover 700 to a depth greater than or equal to a depth of the drainage holes 504, 604 of the plate 500, 600. The friction tabs 708 may also include a hook configured to snap or frictionally fit around the drainage holes 504, 604 and engage with the bottom surface 506, 606 of the plate 500, 600. Although the hooks of the friction tabs 708 are shown facing substantially toward a center of the protective cover 700, the hooks may face in any direction, independent of each other, such that the hook is positioned to be engageable with the bottom surface 506, 606 of the plate 500, 600 via the drainage holes 504, 604.

Although the present disclosure discusses the implementation of these techniques in the context of a drain assembly for a shower, the technology introduced above may be implemented for a variety of drainage needs. A person of skill in the art will understand that the technology described in the context of securing a drain assembly to a shower pan could be adapted for use with other systems such as a bathtub, a sink, shower tiles, etc. Additionally, a person of ordinary skill in the art will understand that the drain assembly may be implemented or installed with a variety of setups.

Those skilled in the art will recognize that the methods and systems of the present disclosure may be implemented in many manners and as such are not to be limited by the foregoing aspects and examples. In this regard, any number of the features of the different aspects described herein may be combined into single or multiple aspects, and alternate aspects having fewer than or more than all of the features herein described are possible. Functionality may also be, in whole or in part, distributed among multiple components, in manners now known or to become known.

Moreover, the scope of the present disclosure covers conventionally known manners for carrying out the described features and functions, and those variations and modifications that may be made to the components described herein as would be understood by those skilled in the art now and hereafter. In addition, some aspects of the present disclosure are described above with reference to block diagrams and/or operational illustrations of systems and methods according to aspects of this disclosure. The functions, operations, and/or acts noted in the blocks may occur out of the order that is shown in any respective flowchart. For example, two blocks shown in succession may in fact be executed or performed substantially concurrently or in reverse order, depending on the functionality and implementation involved.

Further, as used herein and in the claims, the phrase "at least one of element A, element B, or element C" is intended to convey any of: element A, element B, element C, elements A and B, elements A and C, elements B and C, and elements A, B, and C. In addition, one having skill in the art will understand the degree to which terms such as "about" or "substantially" convey in light of the measurements techniques utilized herein. To the extent such terms may not be clearly defined or understood by one having skill in the art, the term "about" shall mean plus or minus ten percent.

Numerous other changes may be made which will readily suggest themselves to those skilled in the art and which are encompassed in the spirit of the disclosure and as defined in the appended claims. While various aspects have been described for purposes of this disclosure, various changes and modifications may be made which are well within the scope of the disclosure. Numerous other changes may be made which will readily suggest themselves to those skilled in the art and which are encompassed in the spirit of the disclosure and as defined in the claims.

What is claimed is:

1. A shower drain assembly comprising:
- a receptor including:
  - an upper portion; and
  - a lower portion couplable to a drain pipe; and
- a threaded flange including:
  - a flange with a top surface;
  - a threaded portion extending orthogonal to the flange opposite the top surface, the threaded portion configured to thread into the upper portion of the receptor;
  - an interior cavity inside the threaded portion extending in a direction orthogonal and opposite the top surface;
  - a ridge inside the interior cavity extending in a direction parallel with the top surface; and
  - a membrane coupled to a bottom surface of the ridge opposite the top surface, and wherein the membrane is configured to sustain a pressure to test a seal of a shower drain assembly.

2. The shower drain assembly of claim 1, wherein the ridge of the threaded flange is positioned in a middle two thirds of the interior cavity.

3. The shower drain assembly of claim 2, wherein the membrane of the threaded flange is coupled to the ridge via a sonic weld.

4. The shower drain assembly of claim 3, wherein a cavity internal diameter of the interior cavity of the threaded flange is greater than a receptor internal diameter of the lower portion of the receptor.

5. The shower drain assembly of claim 3, wherein a direction of the sonic weld is aligned with a direction of the pressure to test the seal of the shower drain assembly.

6. The shower drain assembly of claim 5, wherein the membrane of the threaded flange is de-couplable from the ridge by exerting a force in a direction opposite the direction of the sonic weld.

7. The shower drain assembly of claim 3, wherein the membrane of the threaded flange is less than 3 mm in thickness and is composed of a flexible elastomer.

8. A threaded flange for a shower drain assembly, the threaded flange comprising:
- a flange with a top surface;
- an interior cavity with an internal diameter, the interior cavity extending in a direction orthogonal and opposite the top surface;
- a ridge inside the interior cavity extending in a direction parallel with the top surface; and
- two or more tabs protruding into the interior cavity and extending between the top surface and the ridge.

9. The threaded flange of claim 8, wherein the two or more tabs each include a vertical tab surface orthogonal to the top surface, wherein the vertical tab surface is configured to sustain an orthogonal force to cause rotation of the threaded flange.

10. The threaded flange of claim 9, wherein the vertical tab surface is configured to receive a handle of a tool at each of the two or more tabs.

11. The threaded flange of claim 8, wherein the ridge and the two or more tabs are positioned in an upper half of the interior cavity proximate the top surface.

12. The threaded flange of claim 8, wherein the two or more tabs are configured to align with two or more recesses of a hair strainer.

13. The threaded flange of claim 8, wherein the top surface includes at least one inset.

14. The threaded flange of claim 13, wherein the at least one inset is configured to facilitate removal of a fixture abutting the top surface and coupled to the threaded flange.

15. The threaded flange of claim 8, the threaded flange further including:

a membrane positioned parallel to the top surface, wherein an edge of the membrane is coupled to the ridge.

16. A shower drain assembly comprising:

a receptor positionable below a shower pan, the receptor including internal threads;

a threaded flange positionable above the shower pan, the threaded flange including:

external threads;

an interior cavity;

a ridge in the interior cavity extending into the interior cavity;

tabs in the interior cavity to rotationally tighten the external threads of the threaded flange into the internal threads of the receptor; and a membrane sonically welded to the ridge;

a plate including drainage holes and stiff tabs configured to frictionally fit into the interior cavity of the threaded flange; and a protective cover to obscure the plate, the protective cover including:

flexible tabs configured to frictionally fit into one or more drainage holes of the plate; and a lip configured to overlap an edge of the plate.

17. The shower drain assembly of claim 16, wherein the protective cover is a flexible elastomer.

18. The shower drain assembly of claim 16, wherein the flexible tabs of the protective cover are spaced radially about the protective cover.

19. The shower drain assembly of claim 16, the shower drain assembly further including:

a hair strainer, wherein the hair strainer includes recesses configured to align with the tabs of the threaded flange.

20. The shower drain assembly of claim 16, wherein the threaded flange further includes a flange with a top surface opposite the interior cavity and wherein the top surface includes insets that, when the plate is frictionally coupled to the threaded flange, facilitate decoupling of the plate from the threaded flange.

* * * * *